US005560180A

United States Patent [19]

Rodriguez et al.

[11] Patent Number: 5,560,180

[45] Date of Patent: Oct. 1, 1996

[54] METHOD AND APPARATUS FOR TYING BUNDLES WITH A PAPER PULP STRAP

[75] Inventors: Peter A. Rodriguez, Atlantic Beach; Craig R. Austin, Jacksonville, both of Fla.

[73] Assignee: Sandar Industries, Inc., Atlantic Beach, Fla.

[21] Appl. No.: 286,344

[22] Filed: Aug. 5, 1994

[51] Int. Cl.[6] ..... B65B 13/02

[52] U.S. Cl. ..... 53/399; 53/589; 100/29

[58] Field of Search ..... 53/399, 582, 589; 100/26, 29, 32, 33

[56] References Cited

U.S. PATENT DOCUMENTS

| | | | |
|---|---|---|---|
| 4,177,724 | 12/1979 | Johnson, III et al. | 100/32 |
| 4,661,185 | 4/1987 | Kobiella | 100/33 PB |
| 4,781,110 | 11/1988 | Sakaki et al. | 100/26 |
| 4,938,009 | 7/1990 | Takami | 100/33 PB |
| 5,294,407 | 4/1994 | Schuttler et al. | 100/33 PB |

*Primary Examiner*—Lowell A. Larson
*Assistant Examiner*—Gene L. Kim
*Attorney, Agent, or Firm*—Arthur G. Yeager

[57] ABSTRACT

Method and apparatus for tying bundles with straps made of paper pulp fibers. The machine is positioned transverse to a conveyor upon which bundles are moved into position for tying. The machine includes a track for guiding the strap around the bundle, applying an adhesive to the forward end of the strap, clamping the forward end of the strap, tightening the strap around the bundle, pressing the forward end against an overlapped portion of the strap until the adhesive cures, cutting the rear end of the strap, and releasing the bundle to be conveyed to a position for unloading from the conveyor.

19 Claims, 3 Drawing Sheets

METHOD AND APPARATUS FOR TYING BUNDLES WITH A PAPER PULP STRAP

BACKGROUND OF THE INVENTION

This invention relates to a method and an apparatus for packaging bales of material by using a paper pulp strap.

A specific segment of the paper industry concerns itself with the manufacture of paper pulp for use in other paper-making operations. Pulp is packaged in bales of stacked, cut sheets. Pulp bales are commonly 16" high 33" square and weigh approximately 550 lbs. After the sheets are stacked, they are compressed and wrapped with larger sheets of paper and usually tied with wire. The bales are then unitized in large stacks and held in the warehouse for later distribution, either within the manufacturing paper company's operations or for sale to other paper mills.

When the end user receives these bales and prepares them for processing, they must be untied so that the wire does not foul the hydropulping system, which redissolves the paper fibers in water for further processing. If the wire is not efficiently removed from the bale, it may follow the bale into the hydropulping system and wrap around the large impellers that agitate the slurry. This fouling reduces efficiency and requires frequent shutdown of the machinery to remove it. Manually handling the wire for disposal exposes the operator to potentials for puncture or cut injuries from the wire since the wire is usually under some tension when it is cut and has a tendency to rebound, or whip.

This invention provides a banding system that uses a repulpable band that can be easily repulped in the hydropulper along with the pulp. A novel apparatus is provided to apply the band to the pulp bales as they are manufactured.

The repulpable band used for this purpose is described in U.S. Pat. No. 4,659,029 to Rodriguez. This tape is a plurality of twisted yarns glued adjacent to one another by a water-soluble adhesive to form a uniform, flat band. The adhesives and paper used in manufacture of this band may be specifically formulated to be easily repulped. The band may be made weather-resistant or water-resistant, if repulping is not necessary. As can be seen, if this band is used to strap bales of pulp, it would pose a lower risk of contamination if lost in the hydropulper. The band is also much softer than wire and poses significantly less potential for injury to the operators handling it. This will also reduce the waste by-product of wire from the paper making process.

It is an object of this invention to provide a novel method and apparatus of applying a tight, encircling strap around a bundle of material. It is another object of this invention to provide a novel method and apparatus of employing a strap made of repulpable paper to tie a bundle of material. Still other objects will appear from the more detailed description which follows.

BRIEF SUMMARY OF THE INVENTION

This invention relates to a strapping station apparatus to be used in combination with a horizontal conveyor moving bales of material through the strapping station. The strapping station is mounted on a movable platform and includes an encircling track for guiding the strap around the bale and a sealing head which contains a driving wheel to advance the strap in the track and, upon reversing the driving wheel, to tighten the strap around the bale, a clamping cam wheel, an adhesive applicator, a clamp to hold together two overlapping pieces of strap with adhesive applied until the adhesive has cured, and a cutter to sever the continuing strap and release it to be a tight band around the bale.

The invention also relates to a method of encircling a bale of material with a repulpable paper strap, applying an adhesive to the forward end of the strap, overlapping the adhesive-coated strap with the continuing strap, pressing the overlapped portion until the adhesive is cured, cutting the continuing strap and releasing the strap to form a tight band around the bale.

In specific and preferred embodiments the strap is a combination of side-by-side twisted strands of repulpable paper fibers, and the adhesive connecting the strands is water-soluble. Thus, the adhesive applicator may be no more than a water applicator which will soften or reconstitute the adhesive in the paper band and upon pressing and curing fastens the paper strap to itself. In another embodiment the track is a U-shaped channel having two parallel spaced side walls with aligned and opposing grooves in the sidewalls adapted to form a guideway to support the strap in the track. In still another preferred embodiment the sealing head is mounted on a pivotable arm allowing the head to be pivoted close to the bale as the strap is tightened around the bale.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The advantages and features of this invention are best understood by reference to the attached drawings.

Figure 1:
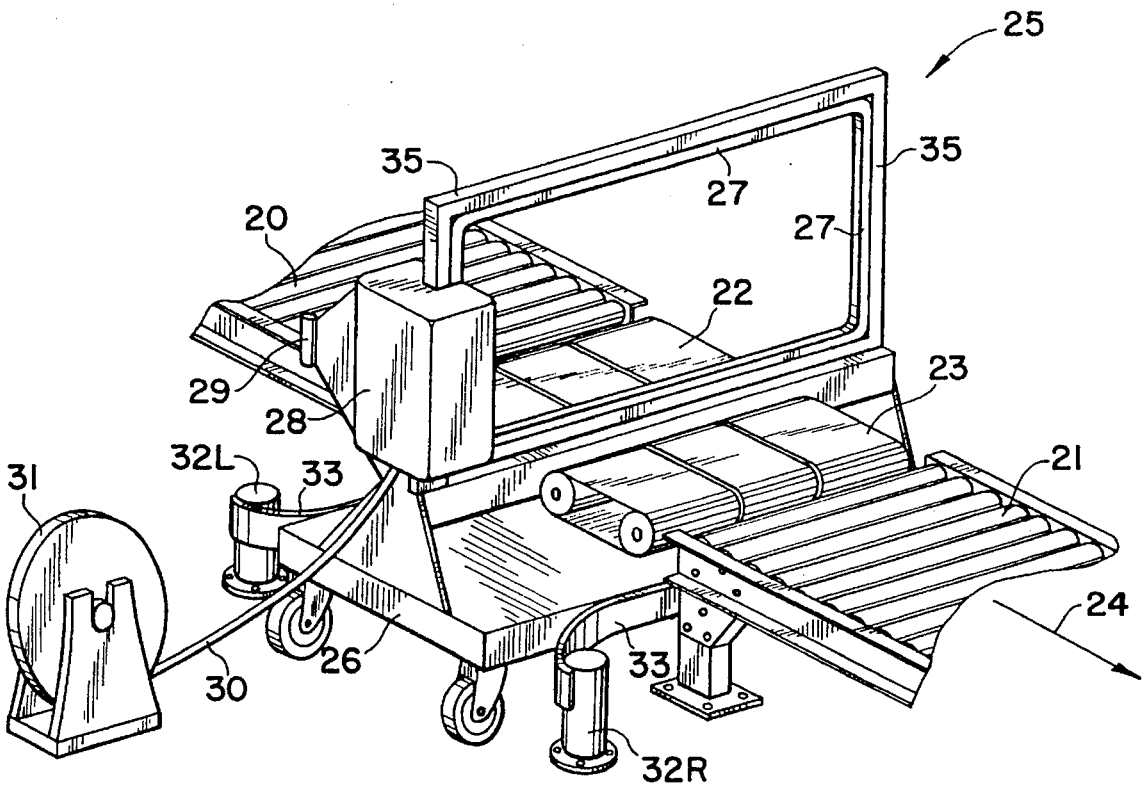
FIG. 1 is a perspective view of a conveyor with the strapping station of this invention in place for applying a strap to a bundle moving on the conveyor.

In FIG. 1 there is shown the arrangement for having a strapping station at a selected location along a conveyor where the conveyor is interrupted to insert the strapping station. The upstream portion 20 of the conveyor and the downstream portion 21 of the conveyor are prepared for moving materials along in the direction of arrow 24. The strapping station 25 includes a movable platform 26 which may be mounted on wheels as shown and which fits neatly into an interruption space between conveyor portions 20 and 21. Station 25 is made movable so as to be pulled away from the conveyor 20, 21 when it is not needed or is inoperable or needs servicing. This allows for a second strapping station to be inserted while the first one is being serviced or repaired. Floor mounted posts 32L and 32R with attached steel bands 33 may be employed to guide strapping station 25 into its proper position between the split conveyor portions 20 and 21 and the bands 33 provide impact barriers for the fixed conveyor portions 20 and 21.

Platform 26 supports upstream section 22 and downstream section 23 of the conveyor to fill in the space necessary to provide conveyor support for bundles or bales passing through the strapping apparatus. Opitonally conveyor sections 22 and 23 may be integral with conveyor portions 20 and 21 respectively. Between conveyor sections 22 and 23 is a rigid encircling track 27 and its supporting rigid framework 35 which serves to guide the strap 30 that is tightened around the bundle or bale (not shown in FIG. 1). The remaining controls and operating equipment are housed in sealing head 28 which is movable toward or away from the bundle or bale on conveyor sections 22 and 23. A preferred means for movement is for sealing head 28 to be mounted on a vertical pivot pin 29 allowing sealing head to pivot horizontally toward or away from conveyor 20, 21; and into and out of alignment with track 27. Another embodiment for sealing head 28 is for it to be mounted so it can be moved linearly toward and away from the bundle, e.g. by the action of a hydraulic or pneumatic cylinder. The sealing head 28 may also be mounted above or below the bundle 47 (see FIG. 2) to be strapped and made to pivot about a horizontal axis. The position shown is preferable in that it is most convenient for machine structure and maintenance. A supply roll 31 of repulpable paper strapping 30 is shown as located separately from platform 26. It is also entirely operable, and in some cases preferred, for supply roll 31 or its equivalent to be mounted on platform 26 so as to move with any movement of platform 26.

Figure 2:
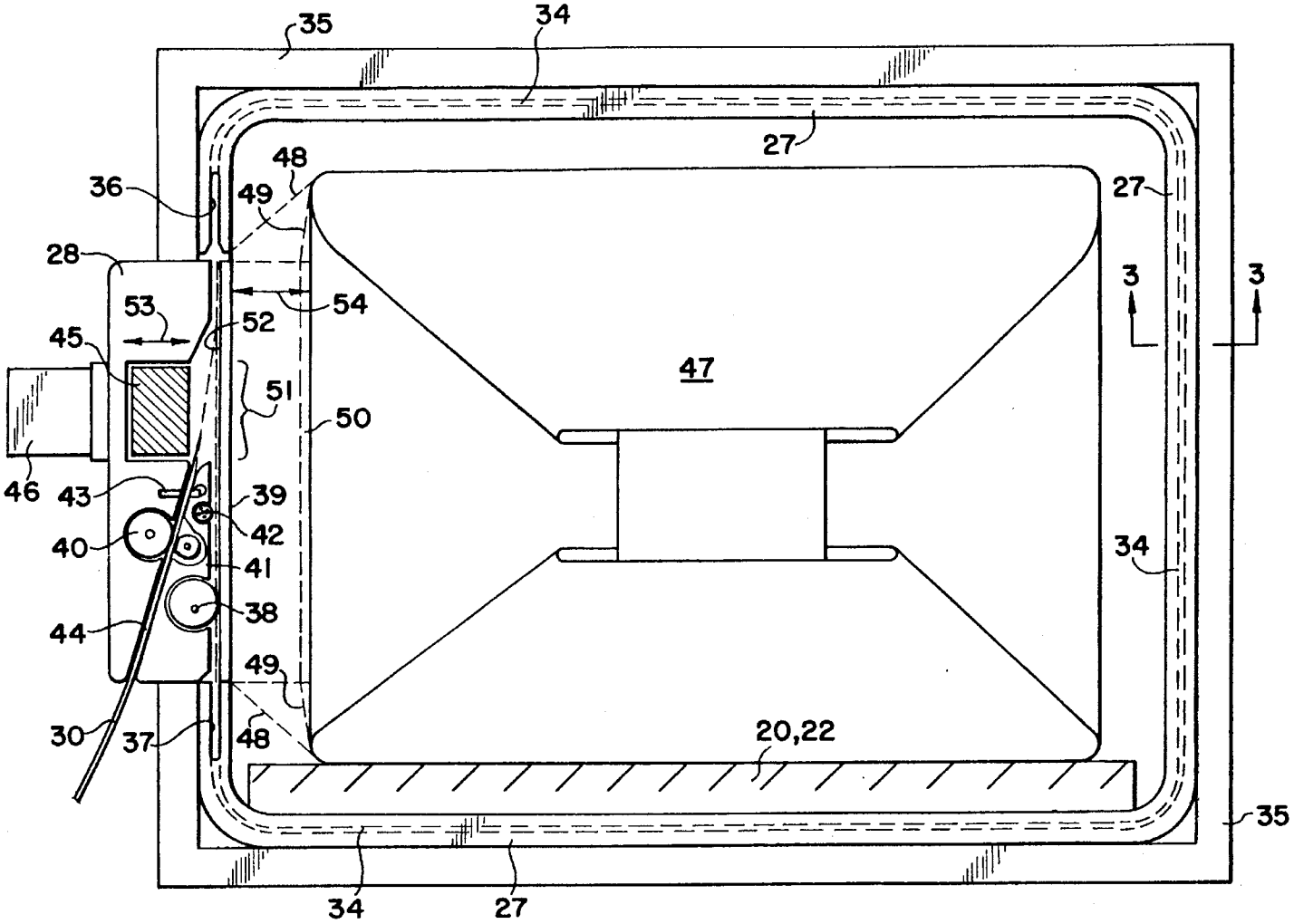
FIG. 2 is an end elevational schematic view of the strapping station applying a strap to a bundle.

In FIG. 2 there is shown the interior of sealing head 28 and the general operational features of track 27. A bale or bundle wrapped in a cover, is shown at 47 stopped in strapping station 25 for the purpose of having a tight strap placed around bale or bundle 47. Conveyor 20, 21 is at an appropriate level for bale 47 to move through the center of encircling track 27.

Figure 3:
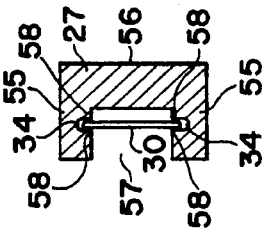
FIG. 3 is a cross-sectional view of the track as taken at 3—3.
Figure 5:
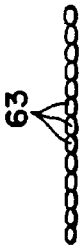
FIG. 5 is a cross-sectional view of the preferred repulpable paper strap to be used in this invention.

As seen in FIG. 3 track 27 is a U-shaped channel having two parallel side walls 55, a bottom wall 56, and an open top 57. Spaced upwardly from bottom wall 56 are two small grooves 34, one in each side wall 55, facing each other and in alignment, i.e., the same distance above bottom wall 56. Each groove 34 forms two spaced shoulders 58 where groove 34 intersects the inside of side wall 55. Supported in grooves 34 and resting on two shoulders 58 is strap 30. The size of grooves 34 is such that it is able to retain strap 30 therein as strap 30 slides along track 27. Strap 30 will not fall out of grooves 34 regardless of the orientation of track 27, and so grooves 34 form a suitable guideway for strap 30. Other designs of track 27 are operable. It is only necessary that a guideway, such as that resulting from grooves 34, be present to direct strap 30 around the bundle or bale to be tied. Strap 30 is accurately illustrated in its preferred form in FIG. 5. Strap 30 is a plurality of small strands 63, e.g., 10–20 are placed side-by-side and a water-soluble adhesive is applied thereto and allowed to cure. The result is the strap of FIG. 5 which is flexible, and yet somewhat stiff, in the same fashion as a thin sliver of wood might be. Such a strap may be made in various sizes, e.g., from about 1–5 cm. wide and about 1–5 mm thick.

The sealing head 28 (FIG. 2) shows a slotted path or guideway 44 of a size to allow strap 30 to pass therethrough leading strap 30 into head 28 and toward entrance 36 to guideway 34 in track 27. Drive wheel 40 and idler wheel 41 are movable toward and away from each other to grip or release strap 30 when pressed against strap 30 the counterclockwise movement of drive wheel 40 causes strap 30 to advance into entrance 36 and completely around track 27 to to emerge at exit 37 to pass along and in contact with a rigid anvil plate 39. When the forward end of strap 30 reaches point. 52 after passing completely around track 27, eccentric cam wheel 38 is activated to turn so that its surface engages strap 30 and presses strap 30 against rigid anvil plate 39. This clamps strap 30 in an immobile position. As the forward end of strap 30 passed adhesive applicator station 42, a thin film of adhesive was applied to the outside (left side in the illustration of FIG. 2) of the forward end of strap 30. Drive wheel 40 is then reversed and turns clockwise to cause strap 30 to be tightened around bale 47. This tension force causes strap 30 to be pulled out of grooves 34 and against bale 47. When all of strap 30 is pulled away from track 27, it will be in the position shown at 48 in FIG. 2. Having removed most of the available slack, the drive wheel 40 will attempt to pull the forward end of strap 30 out of the sealing head 28. But this is prevented by the self-locking design of cam wheel 38 which will move to grip the band more tightly. Later the tension will pull the entire sealing head 28 against bale 47 with anvil 39 in position 5D arid strap 30 in position 49. At this point there is formed an overlapping section 51 with a portion of the forward end of strap 30 overlying a portion of the continuing strap 30 and a layer of adhesive between the two layers of strap 30. Press head 45 is then moved toward anvil plate 39 by the force of hydraulic cylinder 46, or any suitable alternative force, e.g., a pneumatic cylinder, a spring, a mechanical lever, an electric powered screw, or the like. The clamping together of the overlapping strap portions spreads the interlayer of adhesive throughout the two overlapped strap portions and holds everything in place until the adhesive cures. If needed, head 45 may also provide heat to assist in curing the adhesive. After a preset time has passed, press head 45 is released and cutter 43 severs the continuing portion of strap 30.

Figure 4:
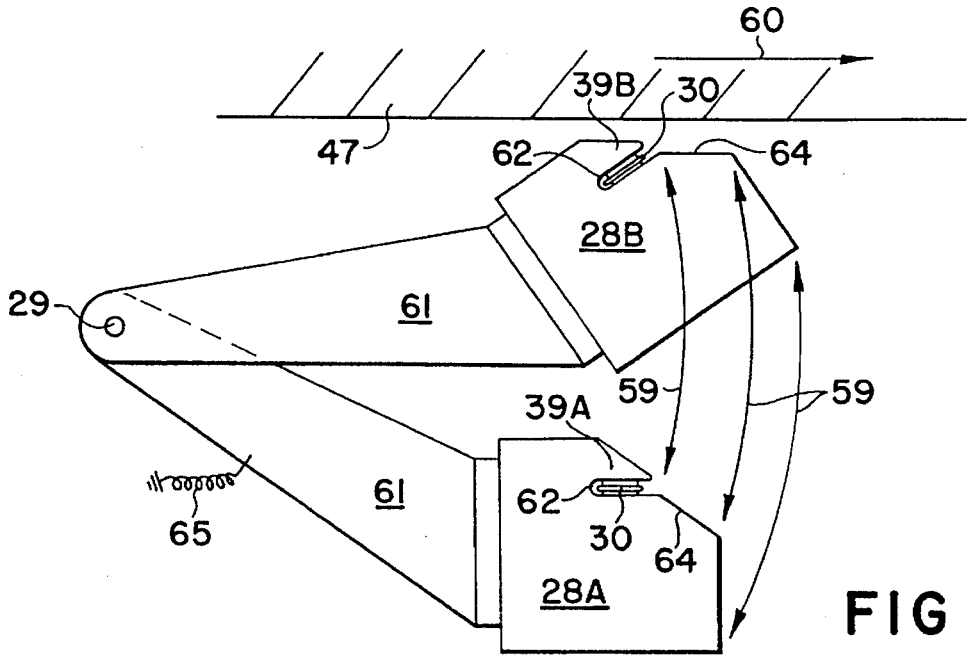
FIG. 4 is a schematic top plan view showing the movement of the sealing head.

FIG. 4 illustrates how sealing head 28 moves while strap 30 is being tightened around bale 47 and how the sealed strap is released to bale 47. Sealing head 28 is mounted on an arm 61 which extends upstream of strapping station to a pivot 29. Preferably pin 29 is vertical and sealing head is positioned to face a vertical side of bale 47 as it moves along conveyor 20, 21. Sealing head has a vertical slot therethrough which serves as the guideway to lead strap 30 from supply roll 31 through sealing head 28 to guideway entrance 36 (see FIG. 2). Sealing head is in position 28A when strap 30 is first introduced into guideway 34 to encircle the bale or bundle to be strapped. When strap 30 is tightened by the reversal of drive wheel 40, the tension in strap 30 causes it to be tensioned around the surface of bale 47 and also it causes sealing head 28A to move toward the position of 28B (FIG. 5) very close to or in contact with bale 47. Anvil 39 is at position 39A at the beginning of the strapping operation and ends up at position 39B when the adhesive seal is curing. As soon as the seal is cured, the conveyor 21 is activated to move bale 47 out of strapping station 25 and on to its eventual location, e.g., storage or shipping. The movement of bale 47 is in the direction of arrow 60 in FIG. 5 and this carries strap 30 in sealing head 28B out of guideway 62 which allows the strap to snap tight against bale 47, and the sealing head 28B to return to position 28A in alignment with guideway 34 by, for example, a spring 65 or other means known in the art. The nose 64 of sealing head 28 is beveled to make it able to pivot with guideway 62 as close to bale 47 as possible.

Figure 6:
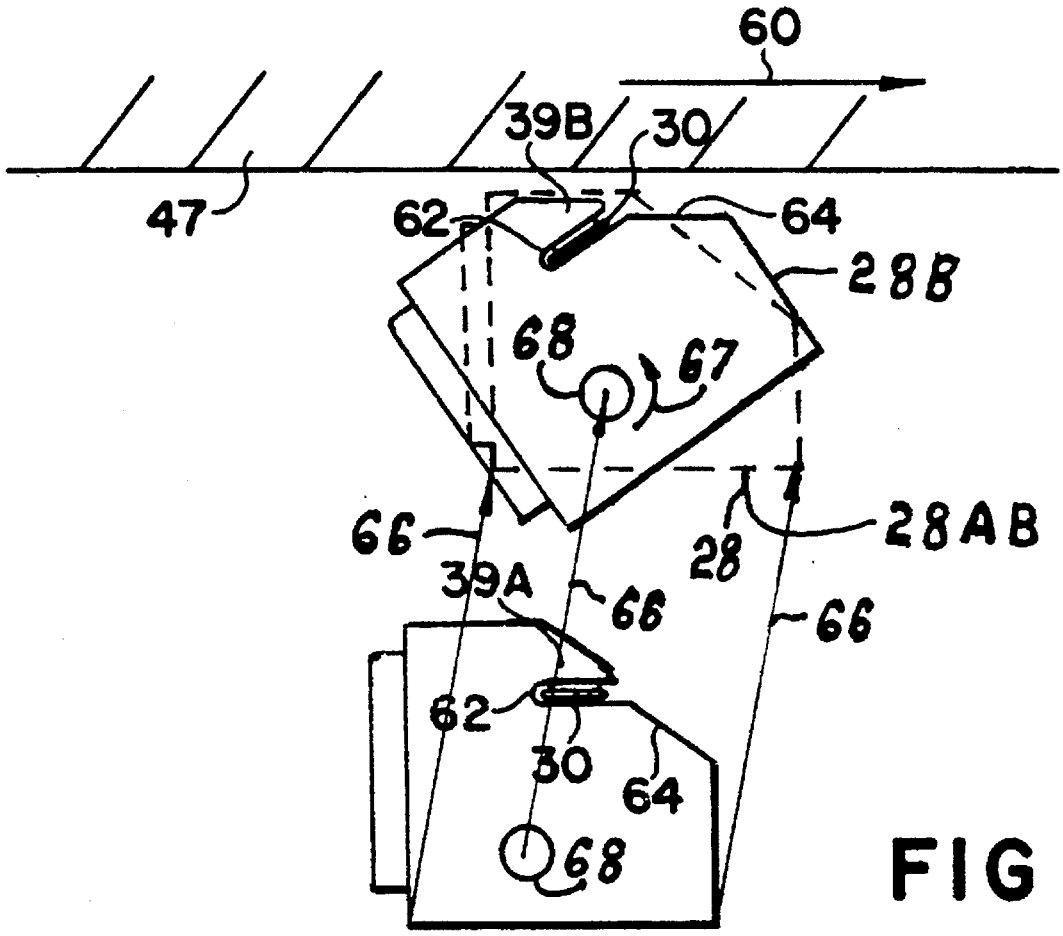
FIG. 6 is a schematic top plan view showing an optional movement of the sealing head as compared to that shown in FIG. 4.

FIG. 6 shows an optional means for moving sealing head 28 toward and away from bundle 47 which is being tied with strap 30. Sealing head has an initial strap guiding position 28A, and during the tying process sealing head must be moved to final position 28B. It is not important how head 28 makes that movement. The tensioning of strap 30 pulls head 28 toward final position 28B, and there may be other forces used to adjust head 28 to an accurate final location. Hydraulic or pneumatic cylinders, levers, gears, tracks or the like may be employed, it only being necessary to move head 28 from initial position 28A to final position 28B. FIG. 4 shows a pivot operation. In FIG. 6 head 28 in initial position 28A (identical to 28A in FIG. 4) is moved linearly in the direction of arrows 66 by the tensioning of strap 30 to position 28AB (in dotted lines) and then is pivoted about pin 68 in the direction of arrow 67 to final position 28B.

Other arrangements can be imagined, e.g. orienting head 28 to the same orientation as in 28B when it is in initial position 28A. Then when needed head 28 moves in a straight line from its initial position to 28B position without the necessity of pivoting at intermediate position 28AB. These movements may be accomplished with hydraulic or pneumatic cylinders, gears, a system of levers, or a combination of such.

The method of this invention involves the successive step of (1) encircling a bundle of material with a length of a tape of repulpable paper fibers to produce an overlapping of the two ends of the tape; (2) tightening the strap around the bundle; (3) applying a water-soluble adhesive to those ends and pressing together the ends coated with adhesive; (4) allowing the adhesive to cure; and (5) releasing the tape to form a tight encirclement around the bundle. It is particularly preferred to apply this method to a bundle of repulpable paper sheets, and to pass the strap around the bundle by passing it through an encircling guideway with the strap of repulpable paper fibers retained in a track including a pair of grooves that support each edge of the tape on shoulders that are spaced apart so as to leave the center of the tape unsupported. After the tape has encircled the bale while held in the grooves in a track, the tape is immobilized at one end while tension is applied at the other end causing the tape to be stripped out of the track and to tightly encircle the bale of paper sheets. Subsequently adhesive is applied between overlapping portions of the strap; the adhesive is cured; and the continuing portion of the strap is cut to produce a tight strap encircling the bale.

This strapping machine has been described in specific relation to the strapping of pulp bales. However, it is to be understood that any number of package shapes, sizes and materials may be strapped by this machine and/or by certain modifications thereto, including enlarging or otherwise reshaping the arch; repositioning the sealing head; or modifying or replacing the conveyor portions 22 and 23 to accomodate different packaging line configurations.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A strapping station for cooperation with and between an upstream and a downstream horizontal conveyor upon which loose bales of material are moved to be wrapped into tight bales comprising a support platform locatable transversely with respect to a longitudinal direction of said conveyors and between said conveyors, a strapping machine mounted on said platform, said strapping machine including an arched track having spaced vertical and horizontal members for guiding a strap transversely and completely around a loose bale disposed within said arched track, said strapping machine including a sealing station adjacent one said vertical members and having an automatic means for selectively gripping a forward end of a strap, said sealing station having a reversible drive wheel for driving a strap forward through said track with an overlap of a strap located adjacent said one vertical member and for applying reverse force to tighten a strap around a bale after actuation of said automatic means for selectively gripping, said sealing station having means for connecting overlapped end portions of a strap after tightening a strap about a bale, and said sealing station having means for cutting a strap after overlapped end portions are connected, said strapping machine further including means supported by said platform for movably mounting said sealing station toward a bale during tightening of a strap about a bale.

2. The strapping station of claim 1 wherein said means for connecting includes means for applying adhesive to an outer surface of a strap adjacent a forward end portion thereof, means for clamping a forward end portion and another end portion of a strap to secure a strap together by adhesive applied.

3. The strapping station of claim 1 wherein said reversible drive wheel is serrated and located adjacent an outer surface of a strap, an idle wheel located opposite to said drive wheel adjacent an inner surface of a strap, said drive wheel and said idler wheel being automatically movable toward and away from each other to grip and release said strap.

4. The strapping station of claim 1 wherein said means for connecting includes means for clamping overlapped end portions of a strap, said clamping means including a platen located inwardly of a strap encircling a bale and an automatic pressing head disposed outwardly of a strap generally opposite to said platen, said sealing station having an exit slot for a strap between said platen and said pressing head opening toward a downstream movement of a bale from said track whereby movement of a bale from said strapping station by one said conveyor causes a strap encircling a bale to move out through said exit slot.

5. The strapping station of claim 1 wherein said means for movably mounting includes means for moving said sealing means from a storage position spaced away from said bale to a position closely adjacent to said bale, and means to return said sealing means to its storage position after said bale has been tied.

6. The strapping station of claim 5 wherein said means for movably mounting includes a vertical pivot and a horizontal arm mounting said sealing station to said pivot.

7. The strapping station of claim 6 further comprising means for biasing said horizontal arm transversely away from said longitudinal direction away from a bale after release of said strap from said sealing station by movement of a strapped bale downstream of said track.

8. A method for tying a bundle of material which comprises encircling a bundle of material with a length of a flat strap wherein the length has a leading end portion and a trailing end portion, clamping the leading end portion to restrain rearward movement of the strap while pulling the trailing end portion of the strap to tightly encircle the bundle with the trailing end portion overlapping a leading end portion, applying an adhesive between the strap overlapping portions, pressing the overlapping portions together with the adhesive sandwiched therebetween, and cutting the trailing end portion rearwardly of the adhesive to produce a tightly encircling band around the bundle where clamping, pulling, applying, pressing and cutting are performed by a movable sealing station, further comprising moving the sealing station toward the bundle by the pulling action on the trailing end portion of the strap to minimize the slack of the strap about the bundle.

9. The method of claim 8 wherein the bundle of material is paper pulp and the strap is of repulpable paper fibers and contains an adhesive that is water-soluble, and wherein said applying an adhesive includes the application of water to at least one of the overlapping portions facing another overlapping portion.

10. A strapping apparatus for cooperation with and between an upstream and a downstream horizontal conveyor upon which loose bales of material are moved to be wrapped by said apparatus into tight bales comprising a support platform adapted and arranged to be disposed to a longitudinal direction of and between an upstream and a downstream conveyor, a strapping machine mounted on said platform, a supply of a stiff flat strap of repulpable paper fibers having inner and outer surfaces, said strapping machine including an arched track having spaced vertical and horizontal members for guiding said strap transversely and completely around a loose bale disposable within said arched track, sealing means adjacent one said vertical member for connecting said strap to itself, said sealing means including automatic means for selectively gripping the forward end portion of said strap after passing completely through said arched track, said sealing means including a reversible drive wheel for driving said strap forward through said track with an overlap of said strap adjacent one said vertical member and for applying reverse force on said strap to tighten said strap around a bale after actuation of said selective means, said strapping machine further including means supported by said platform for movably mounting said sealing means toward a bale during tightening of a strap about a bale said sealing means including means for applying an adhesive to an outer surface of said strap adjacent a forward end portion thereof, said sealing means including means for clamping said forward end portion and another portion of said strap over-lapped therewith, after tightening thereof, together with said adhesive being located between said portions, and said sealing means including means for cutting said strap after said portions are tightly secured by said adhesive.

11. The apparatus of claim 10 further comprising means for moving said platform.

12. The apparatus of claim 10 wherein said track includes a transverse cross-section of a U-shaped channel having a pair of spaced parallel side walls, a closed outer wall and an open inner wall, said side walls having aligned, opposing lengthwise grooves adapted to receive said strap therein with lengthwise side edges of said strap being supported therein, said grooves being positioned parallel to and spaced between said inner and outer walls.

13. The means for movably mounting of claim 10 wherein said apparatus includes pivotal mounting means for mounting said sealing means.

14. The apparatus of claim 10 wherein the loose bales of material are stacked sheets of paper pulp and said strap of repulpable paper fibers comprises a plurality of contiguous and connected longitudinal side-by-side twisted paper each being about 1–3 mm in diameter.

15. The apparatus of claim 10 wherein said means for clamping includes a reverse cam lock that inhibits longitudinal reversal of said strap during tightening of said strap.

16. The apparatus of claim 10 wherein said strap includes water-soluble adhesive, said means for applying adhesive including water application means for softening adhesive of said strap prior to said means for clamping being applied to said forward end portion of said strap and said another end portion thereof.

17. The apparatus of claim 10 wherein said means for clamping said strap includes a platen located adjacent said inner surface of said strap and an automatic pressing head adjacent said outer surface of said strap, said sealing means having an exit slot for said strap about a bale in downstream direction of movement of a bale from said track whereby movement of a bale by said downstream conveyor causes said strap encircling a bale to remove out through said exit slot.

18. The means for movably mounting of claim 16 wherein said apparatus includes pivotal mounting means located upstream of said track for mounting said sealing means.

19. The apparatus of claim 10 wherein said reversible drive wheel is serrated and located adjacent said outer surface of said strap, an idle wheel located opposite to said drive wheel adjacent said inner surface of said strap, said drive wheel and said idler wheel being automatically movable toward and away from each other to grip and release said strap.

* * * * *